US006256809B1

(12) United States Patent
Goldschmidt et al.

(10) Patent No.: US 6,256,809 B1
(45) Date of Patent: Jul. 10, 2001

(54) POLLUTION PREVENTION SYSTEM

(75) Inventors: Norman Goldschmidt, Syracuse, NY (US); Andrew Hahn, Rocky Hill, NJ (US)

(73) Assignee: Bristol-Myers Squibb Company, New York, NY (US)

( * ) Notice: Subject to any disclaimer, the term of this patent is extended or adjusted under 35 U.S.C. 154(b) by 456 days.

(21) Appl. No.: 08/723,451

(22) Filed: Oct. 7, 1996

(51) Int. Cl.[7] ..... A47K 1/00
(52) U.S. Cl. ..... 4/625
(58) Field of Search ..... 4/625–627, 516, 4/665, 639, 640, 653, 672

(56) References Cited

U.S. PATENT DOCUMENTS 3,535,715 * 10/1970 Booker et al. ..... 4/653
4,349,436 * 9/1982 Kaump ..... 4/665 X
4,641,680 * 2/1987 Been ..... 4/625 X
5,465,438 * 11/1995 Allman et al. ..... 4/626

FOREIGN PATENT DOCUMENTS

1905572 * 8/1970 (DE) ..... 4/653
0362903 * 3/1971 (DE) ..... 4/625

* cited by examiner

*Primary Examiner*—Charles E. Phillips
(74) *Attorney, Agent, or Firm*—Morton S. Simon; Charles J. Zeller; Theodore R. Furman, Jr.

(57) ABSTRACT

There is disclosed a waste prevention system which avoids the discharge, inadvertent or otherwise, of laboratory waste, into a public sewage system and subsequently into the natural environment. The system employs, in combination, a laboratory sink having cooperatively connect thereto a carboy for collecting pollutants. The carboy is provided with elements to permit removal of samples of materials delivered thereto from the sink for testing of the same to determine the presence of pollutants. In the event no pollutants are present, the carboy may simply be opened and any wash or rinse water from the sink can be delivered into a public sewage system and then to the environment. In the event testing indicates the presence of pollutants, the carboy then can be filled to the required level, which is indicated by a sensing device connected electrically to signaling devices, such as a horn and/or light and which is also connected to the source of washing water and automatically will stop the flow of such washing water into the sink. The carboy can then be removed from the system and stored and/or disposed of, as desired.

13 Claims, 2 Drawing Sheets

POLLUTION PREVENTION SYSTEM

Figure 1:
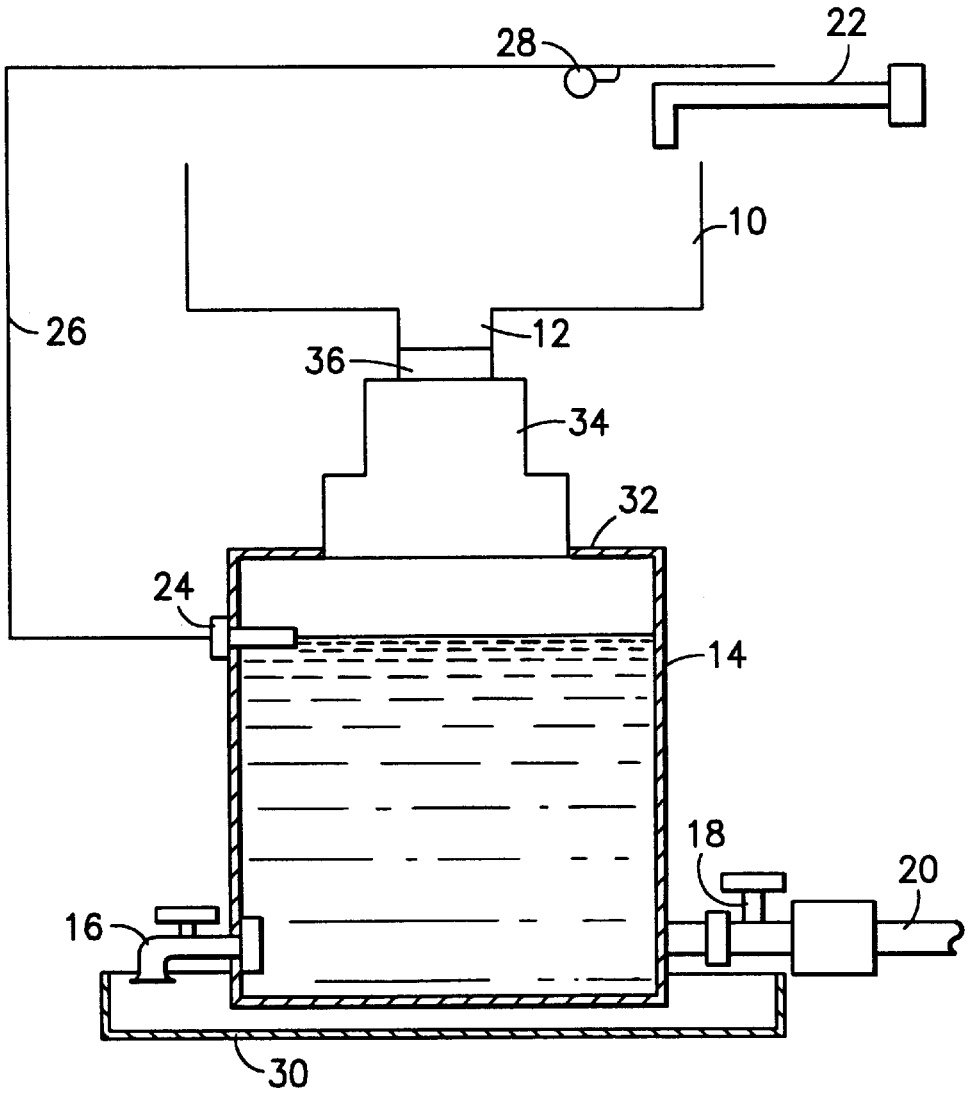

This invention relates to a pollution prevention system. More particularly, it relates to a pollution prevention system which avoids the discharge, inadvertent or otherwise, of laboratory waste, and, particularly hazardous laboratory waste, into a public sewage system and subsequently into the natural environment.

BACKGROUND OF THE INVENTION

A wide variety of waste delivery systems are known in the art. Some of such systems may include steps to remove and/or isolate pollutants, such as hazardous laboratory waste, from waste materials to be delivered to a public sewage system and then into the natural environment, or steps for the treatment of such pollutants within the system to neutralize the same before delivery into a public sewage system and then into the natural environment. Thus, many of the known systems involve relatively sophisticated and complex operational steps and, as well, sophisticated and complex apparatus for accomplishing the same. Moreover, in recent years, the necessity of cleaning up the natural environment has resulted in the enactment of environmental legislation on the part of State and Federal Governments to enhance the quality of the environment by reducing and/or eliminating adverse environmental activities and has resulted in the exertion of pressures on industrial operators in order to not only protect the natural environment but also to protect the public against the adverse effects of industrial pollution and, thus, increase the quality of life for the public in general.

The enactment of environmentally protective laws, including the enforcement of the same by the imposition of severe penalties, has brought about the development of a substantial body of environment enhancing and protecting technology. Some typical examples of recent, relatively simple devices of such technology include U.S. Pat. No. 5,438,713 of Aug. 8, 1995, which discloses a prefabricated bathroom module for installation onto a deck of a marine vessel; U.S. Pat. No. 5,413,705 of May 5, 1995, for a filterless drain separator which discloses structure, such as a centripetal separator, which allows separation of liquid and solids or particulate matter and permits the liquid to pass through and out of the drain while retaining the solids or particulate matter for removal and disposal; U.S. Pat. No. 5,388,288 of Feb. 14, 1995, which discloses a plumbing fitting which serves both as a test closure and a trap bushing for a T-fitting; U.S. Pat. No. 5,333,327 of Aug. 2, 1994, dealing with an apparatus for opening and closing a drain and showing a mechanism for remotely opening and closing a drain of a basin with a flexible rod moving through a non-linear tube; U.S. Pat. No. 5,325,549 of Jul. 5, 1994, which discloses a trap fitting assembly for mounting in flammable floors which prevents the spread of smoke and fire through a floor and ceiling; U.S. Pat. No. 5,267,361 of Dec. 7, 1993, which discloses a drain trap having an L-shaped inlet tube, a cap, a vertical discharge tube and a garbage blocking member; U.S. Pat. No. 5,255,402 of Oct. 26, 1993, which discloses a trap for a sink, or the like, having an easily removable bottom portion which permits the trap to be cleaned and lost articles removed; U.S. Pat. No. 5,249,398 of Oct. 5, 1993, which discloses a cesspool for handling waste water and which is provided with a drainage system having two separate odor locks which prevent the escape of odorless gas from the system through the cesspool; U.S. Pat. No. 5,236,137 of Aug. 17, 1993, which discloses an apparatus and method for garbage disposal cleaning; and U.S. Pat. No. 5,203,369 of Apr. 20, 1993, which discloses a sink trap having a generally semi-global main chamber, a shallow water chamber, a plurality of baffles for supporting the water chamber in the main chamber in an inwardly spaced relation and defining a plurality of volute passageways between the main and water chambers, and a cap detachably secured to the upper edge of the main chamber and an inlet pipe extending axially downwardly through the cap into the water chamber to lead drainage into the water chamber and discharging the drainage by overflowing the water chamber to flow through the volute passageways forming a turbulent liquid flow along a drainage pipe line to prevent the drainage pipe line from becoming choked with impassable matter.

While the above-mentioned Patents are exemplative of a variety of technological developments in some of the simpler and more fundamental areas of developments of environmentally beneficial systems, methods and apparatus and appear to provide answers to the various problems they were developed to overcome, they simply do not recognize the problem of the disposition of waste from research laboratory operations. This is especially so when the disposition, whether it be inadvertent or otherwise, of such laboratory wastes is encountered when cleaning laboratory equipment for further use during normal laboratory research operations.

In many chemical research laboratories in use today, a wide variety of hazardous materials are employed as initial reactants, or such hazardous material are generated as a result of experimental processes undertaken in connection with research activities. Moreover, many such materials may not only be hazardous to the environment and to humans from a health viewpoint, but even highly toxic to the extent that they cause death in humans, animals and plant life. Furthermore, while established operating standards of safety result in the disposition of most of such materials, the possibility of the existence of residues thereof in the laboratory equipment employed therewith during research activities must be taken into consideration when cleaning such equipment in the laboratory sinks, since introduction of such materials into the public sewage system, inadvertently or otherwise, may easily occur with consequent contamination of the public sewage system and the exterior environment. There exists, therefore, a need for providing a system and an apparatus which overcomes this problem. The present invention fulfills this need.

BRIEF STATEMENT OF THE INVENTION

In accordance with the invention, there is provided a pollution prevention system which avoids the discharge, inadvertently and otherwise, of laboratory waste, hazardous and benign, into a public sewage system and then into the exterior environment, the system, comprising in combination a laboratory sink provided with a drain and means for collecting waste material from the sink connected to the drain and provided with at least a pair of valved outlets, one outlet leading to the exterior of the means for collecting waste material and the other outlet connected to a public sewage system.

Still further, in accordance with the invention, there is provided apparatus for carrying out a pollution prevention system which avoids the discharge, inadvertent and otherwise, of laboratory waste, hazardous and benign, into a public sewage system and then into the exterior environment, the apparatus comprising in combination a laboratory sink provided with a drain and means for collecting waste material from the sink connected to the drain and provided with at least a pair of valved outlets, one outlet leading to the exterior of the means for collecting waste material and the other outlet connected to a public sewage system.

THE DRAWINGS

Figure 2:
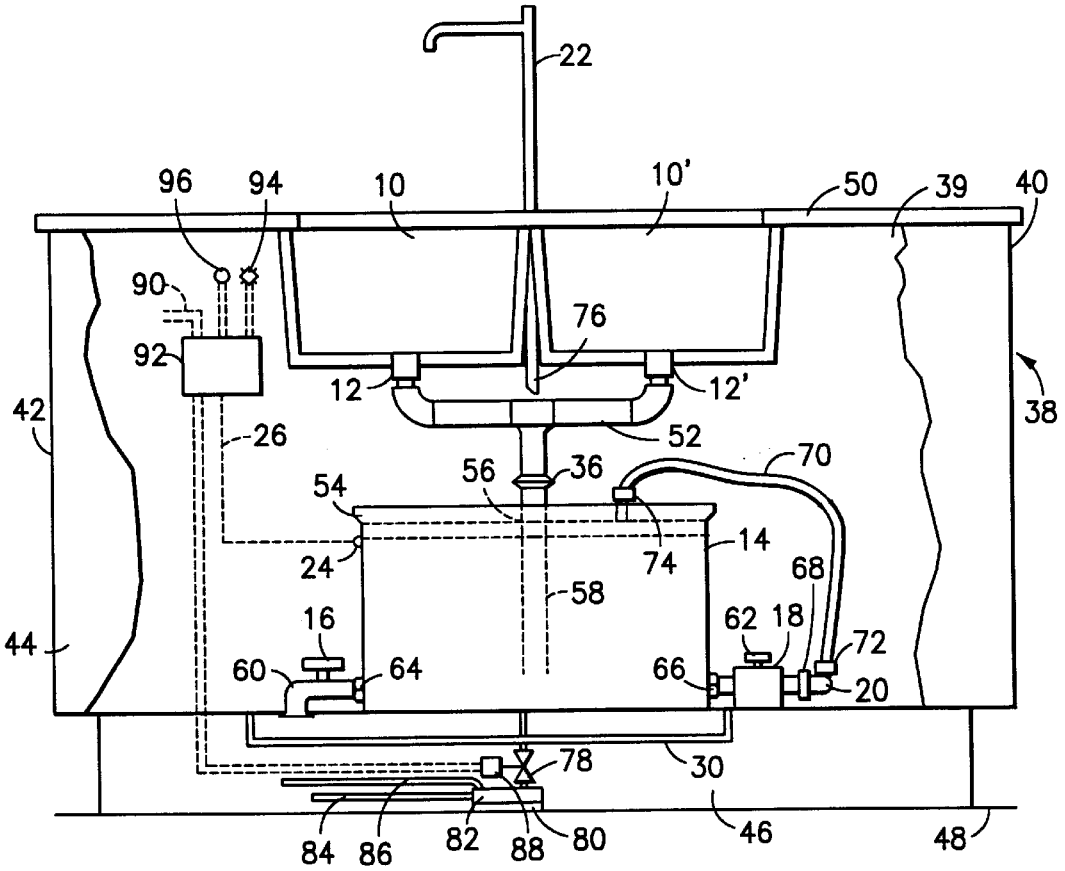

In order to understand the present invention more fully, reference is directed to the attached Drawings which are to be taken in conjunction with the following description of the inventive system and apparatus for accomplishing the same, and wherein:

FIG. 1 is a diagrammatic view in elevation, and partially in section, of apparatus for carrying out the pollution prevention system of the invention, and FIG. 2 is a view in elevation, and partially in section, of a laboratory work bench arrangement for achieving the system of the invention.

DESCRIPTION OF THE PREFERRED EMBODIMENTS

Referring now to FIG. 1, a pollution prevention system according to the invention comprises in combination a laboratory sink 10 provided with a drain 12 connected to a means 14 for collecting waste material from the sink.

The sink 10 may be made of a wide variety of suitable materials which are substantially inert, strong and resistant to destruction by contact therewith of destructive materials over long periods of time, such as strong acidic, basic and radio-active chemicals and the like. For example, the sink may be made from substantially inert heavy stoneware which has been appropriately shaped, or such stoneware which has been provided with a protective surface, such as by grinding and polishing to provide a hard, smooth surface and/or by providing a hard, smooth surface thereto by a glass or inert plastic coating, or the like, such as, for example, of polyethylene, polypropylene, polyhexamethylene adipamide, polyvinylchloride, or polycarbonate and the like. The drain 12, as well as the means for collecting waste material 14, may also be made of glass or of such plastic materials.

Still further, if desirable, the sink, waste collection means and drain may be made of metal, such as steel and the like, or other metallic materials which are resistant to the activity of destructive materials and/or which may be coated with the materials mentioned above.

The collection means for the waste material 14 is also provided with at least one pair of valved outlets 16 and 18. Valved outlet 16 opens directly to the exterior atmosphere of the collection means for the waste material to allow withdrawal of samples of the waste material for testing to determine the presence of undesirable waste materials therein. On the other hand, valved outlet 18 is connected to a public sewage system 20 and will normally remain in a closed position until testing is completed and then opened to permit any waste material collected in the collection means 14 for delivery to the public sewage system and then to the exterior environment.

In addition, the pollution prevention system of this invention includes also a source of wash water, preferably by way of a faucet 22, located in the vicinity of the sink to deliver water thereto and which in turn is connected to an appropriate plumbing system (not shown). It is to be understood, however, that is within the purview of this invention that wash water can be supplied by any convenient arrangement, such as, for example, by way of a hose arrangement, or even by a pail whose contents simply may be emptied into the sink.

While the above brief detailed description of the pollution prevention system of this invention as described sets forth the fundamental operative elements thereof, as a practical matter, the inventive system also is preferably provided with a level sensor 24 located on the exterior surface of the collection means 14 and near the top thereof. The level sensor 24 is connected to an appropriate electrical circuit 26, which in turn, is connected to an alarm 28. Alarm 28 is also preferably connected to faucet 22 in a convenient manner to shut off the flow of washing water when the level of waste material in the collection means has activated the sensor.

Still further, the pollution prevention system, according to the invention, includes the utilization of a drip pan or catch basin 30 which is disposed under the waste collection means 14 and which serves the purpose of collecting any spillage which may occur when taking test samples through valved outlet 16. Drip pan 30 may be made from the same materials as waste collection means 14.

Waste collection means 14 is preferably in the form of a container and may be round, rectangular, or any other desirable and convenient shape. Moreover, while it is preferably provided with an integral top 32, such as shown in FIG. 1, and with an upwardly extending portion 34, the upwardly extending portion is adapted to be connected to the drain 12 by a substantially liquid and air tight collar 36 to prevent leakage of any waste material passing down the drain and into the interior of the container. The collar 36 may be screw threaded or friction fitted to the drain 12 and to the waste collection means, as desired, and collar 36 may be made of the same materials, metallic or plastic, as mentioned above.

Referring now more particularly to FIG. 2, the pollution prevention system of the invention is shown there as incorporated into a working laboratory cabinet or bench arrangement in which the bench or cabinet, generally referred to by numeral 38, is provided with a rear panel 39, side panels 40 and 42 and a front panel 44 resting on a supporting member 46 which in turn is in contact with the laboratory floor 48. Supporting member 46 also includes inwardly extending supports (not visible) to ensure a solid foundation for the system.

The cabinet panels, including rear panel 39, support a counter top 50 provided with a pair of openings to support a pair of laboratory sinks 10 and 10'. The sinks are provided with drains 12 and 12' connected to an additional T-shaped drain member 52. In turn, the T-shaped drain member extends downwardly towards the waste collection means 14 which, in the version illustrated, is a circularly shaped carboy of polypropylene which is provided with an intregally formed cover member 54 having a central opening 56 through which there extends an integrally formed drain pipe 58 which is connected at its upper extremity to the T-shaped drain member 52 by a collar 36 which is preferably a Triclover sanitary connector. As with the system shown in FIG. 1, in the system of FIG. 2, the waste collection means 14, that is the polypropylene carboy, is provided with a pair of valved outlets, one, 16, which in this modification of the system is preferably a needle style sample valve 60 and the other, 18, is a spring type poppet type outlet valve 62. Both of these valves are connected to the carboy through nozzles or lines 64 and 66, respectively. Just downstream from the outlet valve 18, a collar 68, which is preferably a Triclover sanitary connector, couples the outlet valve to a public sewage system 20 and from which a vent hose 70, provided with appropriate barbed nipples 72 and 74 connect the hose to the public sewage systems and to the waste collection means 14, respectively.

The modification of the pollution prevention system shown in FIG. 2 also includes a mixed water spout or faucet 22 provided with a "goose-neck" with vacuum breaker. The water spout on faucet 22 is connected through tubing 76 which extends downwardly towards the supporting member of the cabinet 38. A normally closed solenoid valve 78 is located in the lower portion of the tubing 76 and connected to a spring closed foot pedal 80 which, in turn, is connected through a hot and cold water mixing valve 82 to hot and cold water sources 84 and 86.

The solenoid valve 78 is provided with an activator 88 which is connected to a vacuum source 90 of preferably 120 pounds located in the interior of cabinet 38 behind the front panel 44.

In the modification of the inventive pollution prevention system shown in FIG. 2, the waste collection means 14, that is, the carboy, has, as does the system illustrated in FIG. 1, a level sensor 24 located on the exterior surface of the carboy. The sensor 24 is preferably a non-contact sensor and it is connected through appropriate circuitry 26 to a level alarm controller 92 located just behind the front wall of cabinet 38. The controller 92 is in turn connected to an alarm light 94 and to a horn 96, preferably a piezoelectric horn, both of which elements are located in the front panel of the cabinet 38.

It is to be understood that it is within the purview of this invention to employ a wide variety of readily available elements in constructing a system according to the invention. For example, any of a wide variety of non-contact level sensors which are available in the market place may be utilized so long as they can appropriately be attached to and later removed from the waste collection means, so that the waste collection is means may be removed from the system and appropriately stored and/or disposed of, as desirable. Still further, any of a wide variety of readily available valve elements can also be employed in place of the needle style sample valve 60, as well as in place of the spring type poppet outlet valve. Moreover, any of a wide variety of collars and sanitary connectors readily available in the market place may also be employed in place of the described collars and triclover sanitary connectors, so long as they are capable of functioning without leakage and thus obviate possible pollution problems which would occur by such leakage.

In addition, it is within the purview of this invention to employ any of a wide variety of signaling and alarm devices which are readily available in the market place, that is, either sound emitting horns or various colored lights which may be noticeable by their intensity or intermittent flashing.

Referring now once again to FIG. 1, a pollution prevention system according to the invention generally operates as follows.

Laboratory flasks and the like which have been employed in carrying out experiments and the like and which now must be cleaned for re-use and which may contain pollutants which must be washed away are introduced into the sink 10 and washed and rinsed to remove any such pollutants therefrom. At this stage, valves 16 and 18 are in their closed positions. Thus, any wash and rinsing water passes through the drain 12 and into the waste collection means 14. Should it be desired at any time during with washing and rinsing stage to check for the presence of pollutants in the wash and rinsing water delivered to the waste collection means, valve 16 is simply opened to drain off a portion of the contents which is then appropriately tested for the presence of pollutants by appropriate testing procedures. If no pollutants are detected, valve 18 can then be opened and the contents of the waste collection means can be drained into the public sewage system 20 and subsequently into the general outside environment.

On the other hand, if pollutants are detected, washing and rinsing is continued until the sensor means 24, due to the level of material in the waste collection means, is activated and thus initiates, by way of the electrical circuit 26, a signal by the piezoelectric horn 94 and/or the light 96 and which, at the same time, shuts off the flow of wash water through the faucet 27. When the last event has occurred, the waste collection means 14, such as a carboy, for example, is removed simply by opening collar 36 to separate the waste collection means from the drain 12. The waste collection means can then be removed and closed by disposition of an appropriate air tight and liquid tight cap on the upwardly extending portion 34 thereof. After such sealing, the waste collection means is then simply removed for storage and/or disposition. This procedure is then repeated, as needed.

The present invention presents many advantages. For example, it provides a system which is easily operated, and which, at the same time, employs a wide variety of elements which are readily available in the market place and which can be assembled and utilized in a relatively simple manner. Moreover, the various elements employed and which must be disposed of after utilization of the system, are relatively inexpensive and those parts of the system which are reusable can be salvaged for such further reuse, thus obviating the need to replace them after each use.

Consequently, that portion of the system, once initial costs have been undertaken and due to the fact that such elements can be reused, holds down future costs of operation of the system.

Numerous other advantages of the invention will be readily apparent to those skilled in the art.

Accordingly, this invention is not to be limited to the embodiments disclosed and illustrated herein, except as defined in the appended claims.

What is claimed is:

1. A pollution prevention system which avoids the discharge, inadvertent and otherwise, of laboratory waste, hazardous and benign, into a public sewage system and then into the exterior environment comprising in combination, a laboratory sink provided with a drain, and means for collecting waste material from said sink connected to said drain and provided with at least a pair of valved outlets, one outlet leading to the exterior of said means for collecting waste material and the other outlet connected to said public sewage system.

2. A pollution prevention system according to claim 1 including a level sensor located on the means for collecting waste material, said level sensor being connected to signal means located outside said means for collecting waste material.

3. A pollution prevention system according to claim 1, wherein the means for collecting waste material is a container.

4. A pollution prevention system according to claim 3 wherein the means for collecting waste material is a plastic container.

5. A pollution prevention system according to claim 1, including a drip pan located beneath the means for collecting waste material from the sink.

6. A pollution prevention system which avoids the discharge, inadvertent and otherwise, of laboratory waste, hazardous and benign, into a public sewage system and then into the exterior environment comprising in combination a laboratory sink provided with a drain, means for collecting waste material from said sink connected to said drain and provided with at least a pair of valved outlets, one valved outlet leading to the exterior of said means for collecting waste material and the other valved outlet connected to said public sewage system, and a level sensor located above said valved outlets, disposed on said means for collecting waste material, and said level sensor being connected to signal means located outside said means for collecting waste material.

7. A pollution prevention system according to claim 6 wherein the means for collecting waste material is a container.

8. A pollution prevention system according to claim 6 including a drip pan located beneath the means for collecting waste material from the sink.

9. A pollution prevention system for preventing discharge, inadvertent and otherwise, of laboratory waste, hazardous and benign, into a public sewage system and then into the exterior environment comprising in combination, a laboratory sink provided with a drain, means for supplying washing water to said sink from a source of water located in the vicinity of said sink and provided with automatic shut-off means responsive to a signal, and means for collecting waste material from said sink connected to said drain, at least a pair of valved outlets located on said means for collecting waste material from said sink, one valved outlet leading to the exterior of said means for collecting waste material and the other valved outlet connected to said public sewage system, a level sensor located on said means for collecting waste material, said level sensor and said means for supplying washing water being connected to means for generating said signal which is located outside said means for collecting waste material and connecting said level sensor, said means for supplying washing water and said means for generating said signal to each other through an electrical circuit and said means for generating said signal closing down said source of water when said sensor activates said means for generating said signal.

10. A pollution prevention system according to claim 9, wherein the means for collecting waste material is a container.

11. A pollution prevention system for avoiding the discharge, inadvertent and otherwise, of laboratory waste, hazardous and benign, into a public sewage system and then into the exterior environment comprising in combination, a cabinet having rear, front and side panels resting on a supporting member and a counter top provided with a pair of openings supported on said panels, a pair of laboratory sinks provided with a common drain disposed in said pair of openings of said counter top, means for supplying washing water to said sinks from a source of water located in the vicinity of said sinks and provided with automatic shut-off means responsive to a signal, and means for collecting waste material from said sinks connected to said common drain, at least a pair of valved outlets located on the lower part of said means for collecting waste material from said sinks, one valved outlet leading to the exterior of said means for collecting waste material and the other valved outlet connected to said public sewage system, a level sensor located above said pair of valved outlets on the upper part of said means for collecting waste material, said level sensor and said means for supplying washing water being connected to means for generating said signal which is located outside said means for collecting waste material and connecting said level sensor, said means for supplying washing water and said means for generating said signal to each other through an electrical circuit, said means for generating said signal closing down said source of water to said sinks when said sensor activates said means for generating said signal, and tubing means connected to said means for supplying washing water to said sinks and to a spring closed foot pedal, said foot pedal cooperatively operating with a solenoid valve and mixing valve connected to hot and cold water sources for providing washing water to said sinks through said means for supplying washing water.

12. A pollution prevention system according to claim 11, wherein the means for collecting waste material is a carboy.

13. A pollution prevention system according to claim 11 including a drip pan disposed under said means for collecting waste material.

* * * * *